US007272898B2

(12) United States Patent
McAllister

(10) Patent No.: US 7,272,898 B2
(45) Date of Patent: Sep. 25, 2007

(54) SHOE PROTECTION DEVICE

(76) Inventor: Krystal C. McAllister, 615 E. Portland St., Unit 180, Phoenix, AZ (US) 85004

( * ) Notice: Subject to any disclaimer, the term of this patent is extended or adjusted under 35 U.S.C. 154(b) by 0 days.

(21) Appl. No.: 11/265,957

(22) Filed: Nov. 3, 2005

(65) Prior Publication Data

US 2006/0096127 A1 May 11, 2006

Related U.S. Application Data

(60) Provisional application No. 60/626,846, filed on Nov. 10, 2004.

(51) Int. Cl.
*A43B 13/22* (2006.01)

(52) U.S. Cl. ..... 36/72 B; 36/72 R

(58) Field of Classification Search ..... 36/72 B, 36/72 R, 73
See application file for complete search history.

(56) References Cited

U.S. PATENT DOCUMENTS 1,528,254 A * 3/1925 McConnell ..... 36/72 B
1,701,018 A * 2/1929 Smart ..... 36/72 B
RE19,543 E * 4/1935 Winget ..... 36/72 B
3,095,659 A * 7/1963 McClellan ..... 36/72 B
4,441,264 A * 4/1984 Hantz-Guibas et al. ..... 36/72 B
4,459,764 A * 7/1984 Beck ..... 36/72 B
4,660,301 A * 4/1987 Atwood ..... 36/72 B
4,727,659 A 3/1988 Walker
4,750,278 A * 6/1988 Cates ..... 36/72 B
4,768,296 A * 9/1988 Gibbs ..... 36/72 B

* cited by examiner

*Primary Examiner*—Marie Patterson
(74) *Attorney, Agent, or Firm*—Gardere Wynne Sewell LLP

(57) ABSTRACT

A shoe protection device comprises a metal or plastic member having an arcuate backwall and integrally formed sidewalls which project toward curved distal ends. The device may be formed of an elastically deflectable core part having an outer coating or overmolded layer or a removable sleeve, or the sidewalls and backwall may be formed of a single solid part. The device is adapted to be slipped over the heel of a shoe or boot to protect same while the wearer of the shoe or boot is driving a motor vehicle, for example.

5 Claims, 7 Drawing Sheets

SHOE PROTECTION DEVICE

CROSS REFERENCE TO RELATED APPLICATION

This application claims the benefit of provisional patent application No. 60/626,846, filed Nov. 10, 2004.

BACKGROUND OF THE INVENTION

A longstanding problem in the art of shoe care has been the elimination of scuffing and other damage to the heel parts of shoes worn by a person in various circumstances but including, in particular, driving a motor vehicle. Typically, a person's right foot rests on the accelerator pedal and brake, in a conventional automobile, in such a way that the shoe heel, including the rear or heel portion of the upper part of the shoe, is subject to scuffing and other damage, such as when water and/or mud are present on the floor of the driver's compartment of the vehicle.

Accordingly, what has been needed is a shoe protection device which may be conveniently placed on the rear or heel portion of a shoe while a person wearing the shoe or shoes is driving a motor vehicle or participating in other activity which might result in damage to the heel portion, which device may be easily disposed on the shoe when needed and may also be easily removed therefrom when not needed. Moreover, such a shoe protection device should also be economical to manufacture and perhaps used as a promotional item by shoe manufacturers, product retailers or other entities which may wish to give away novelty items with brand names or other identifying indicia thereon.

It is to meet the above-mentioned desiderata and needs in the art that the present invention has been developed.

SUMMARY OF THE INVENTION

The present invention provides an improved shoe protection device, particularly for protecting the heel portion of a shoe.

In accordance with one aspect of the present invention, an improved shoe protection device is provided which is easily mounted on a shoe while being worn by a person and removed from the shoe when not needed. In particular, the device is useful for protecting the heel portion of a shoe worn by a person driving a motor vehicle wherein the heel portion of the shoe is otherwise subject to scuffing, discoloration or other damage resulting from the position of a person's foot while driving such vehicle. A shoe protection device in accordance with the invention is likely to be worn at least on a person's right shoe, but such devices may be worn on both shoes for operating vehicles that require manipulation of control pedals by both feet, including motor vehicles with so-called manual transmissions and aircraft, for example.

The shoe protection device of the invention is preferably formed of an elastic material and is formed in a somewhat U-shaped configuration such that the device may be easily slipped over the heel portion of a shoe and elastically retained thereon but also be easily removed when not needed, such as when the wearer alights from a motor vehicle.

The shoe protection device of the invention may be formed of a solid elastic material, such as a thermoplastic or a plastic coated elastic metal band or a core part including, for example, a perimeter band of metal or plastic. A fabric or leather cover or the like may be slipped over the metal band or core part and the band or core part retained therein by closing the cover with conventional stitching. The perimeter band may then be shaped to the final configuration using a mold or forming the shape of the device over an anvil. The cover may be replaced or cleaned when needed and may be of aesthetically pleasing design or color, including a color matching the shoe worn by the person using the protection device.

Those skilled in the art will further appreciate the above-mentioned advantages and superior features of the invention, together with other important aspects thereof, upon reading the detailed description which follows in conjunction with the drawings.

BRIEF DESCRIPTION OF THE DRAWINGS

FIG. 7E is a developed plan view of the embodiment shown in FIG. 7A with the cover or envelope completely disposed over the core part and closed by stitching or the like.

DETAILED DESCRIPTION OF THE PREFERRED EMBODIMENTS

Figure 1:
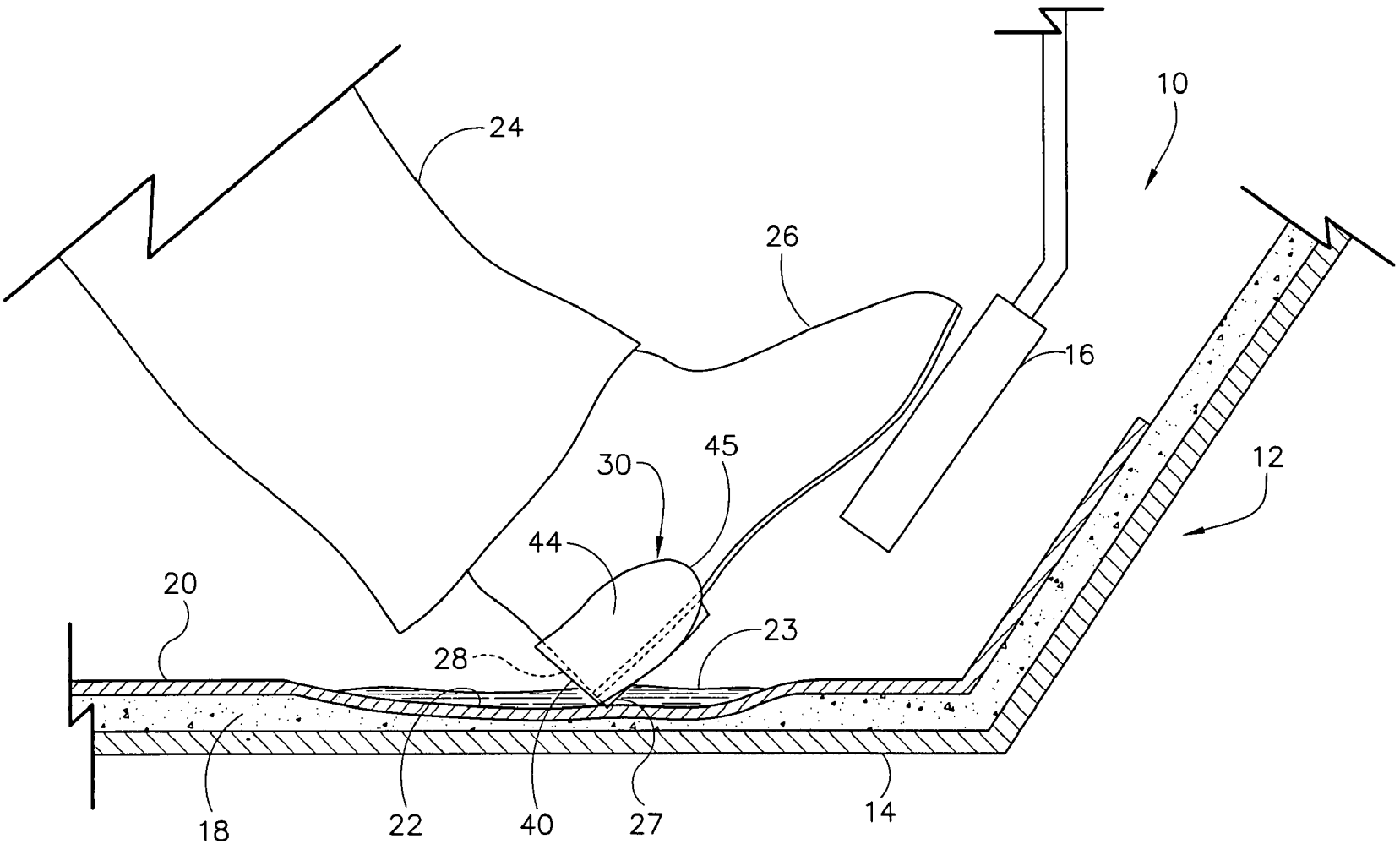
FIG. 1 is a detail side view illustrating the position of a person's foot while driving a motor vehicle and showing the shoe protection device of the invention mounted on the wearer's shoe while the wearer's foot rests on one of the vehicle control pedals.

In the description which follows, like elements are marked throughout the specification and drawings with the same reference numerals, respectively. The drawing figures are not necessarily not to scale and certain features may be shown exaggerated in scale or in somewhat generalized form in the interest of clarity and conciseness.

Referring to FIG. 1, there is illustrated a portion of a driver's compartment 10 of a motor vehicle 12 including a floorboard 14, and a control pedal, such as an accelerator pedal 16, disposed nearby. Floorboard 14 is typically covered by carpeting 18 and a floor mat 20. With extended use, floor mat 20 and carpeting 18, typically, may become depressed at depression 22 which becomes a convenient place for accumulation of material 23, such as dirt, debris, rainwater, melted snow, road salt, sand and so forth. Depression 22 is typically formed after moderate use of motor vehicle 12. However, even without the presence of depression 22, the aforementioned materials may accumulate on the surface of mat 20 and the mat itself may cause damage to the shoe of a person controlling the vehicle.

For example, there is illustrated a person's leg 24 and shoe or boot 26 in a position for operation of pedal 16 whereupon the heel 27 of shoe or boot 26, and the rear upper shoe or boot portion 28 are subject to damage from contact with material 23 and/or the surface of mat 20. However, in accordance with the present invention, such damage is prevented by, as shown in FIG. 1, the presence of a shoe protection device 30 which is disposed about the shoe heel 27 and the portion 28 of the shoe uppers at the heel which would otherwise be subject to such damage. Further detailed description of device 30 follows hereinbelow.

Figure 2:
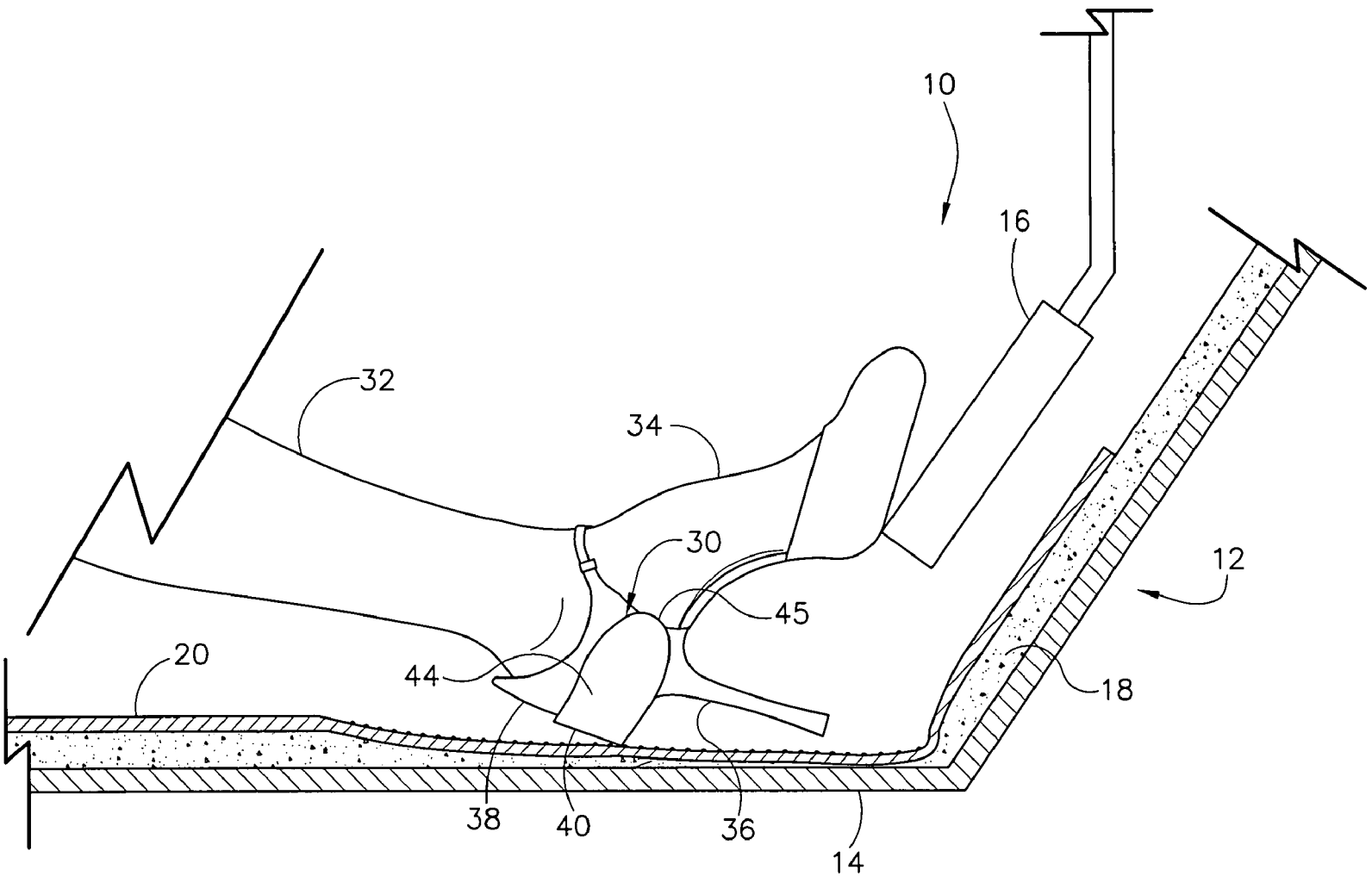
FIG. 2 is a view similar to FIG. 1 showing a woman's high heel shoe with a shoe protection device in accordance with the invention mounted thereon.

Referring briefly to FIG. 2, there is illustrated another person's leg 32 and foot 34 on which a high heeled dress shoe 36 is disposed and, in a typical position of the person's foot for controlling accelerator, brake or clutch pedal 16, the heel portion of the shoe upper, designated by numeral 38, would be subject to damage from floor mat 20 and any debris thereon except also for the presence of a protection device 30 sleeved over and around the upper portion 38 at the heel of shoe 36.

Figure 3:
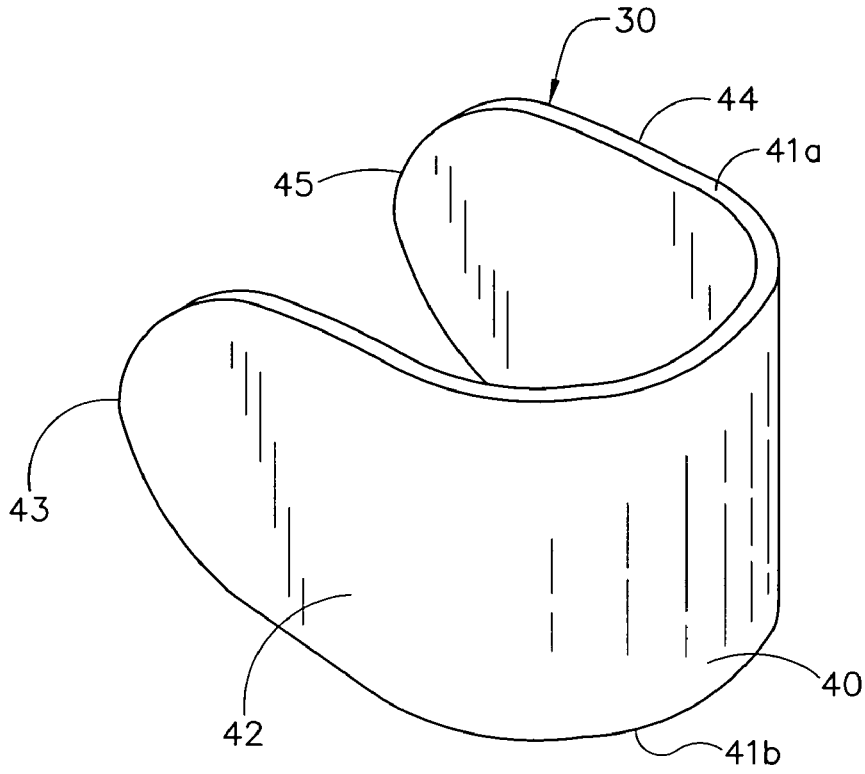
FIG. 3 is a perspective view of one preferred embodiment of a shoe protection device in accordance with the invention.
Figure 4:
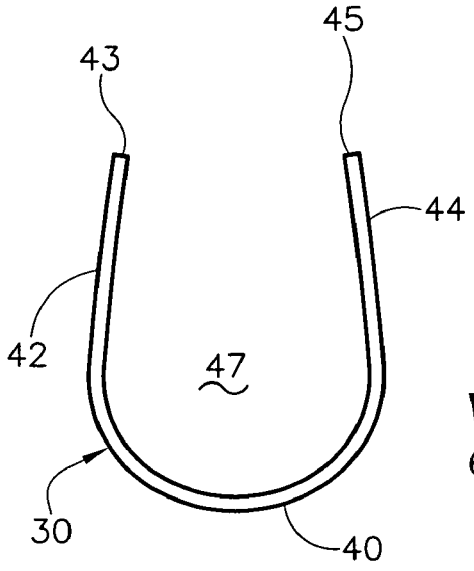
FIG. 4 is a top plan view of the device shown in FIG. 3.
Figure 5:
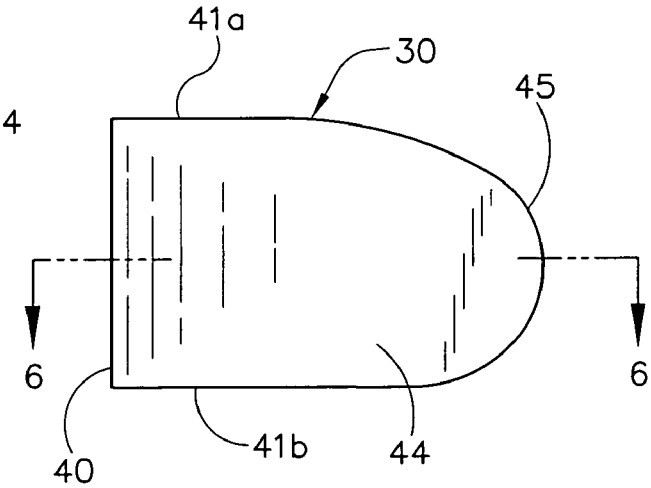
FIG. 5 is a side elevation of the device shown in FIGS. 3 and 4.

Referring now to FIGS. 3 through 5, shoe protection device 30 is shown in a relaxed state and is characterized by an arcuate backwall 40 and opposed sidewalls 42 and 44. Sidewalls 42 and 44 are integrally joined to backwall 40 and are delimited by curved distal ends 43 and 45, respectively, as shown in FIGS. 3 and 5, in particular. The radii of curvature of the distal ends 43 and 45 may take various forms but are proportioned to be aesthetically pleasing and to avoid any sharp edges which might damage a shoe on which the device is disposed. As shown in FIG. 4, in the relaxed state of the device 30, the distal ends 43 and 45 are disposed closer together than the spacing of the sidewalls where they join the curved back or end wall 40. Distal ends 43 and 45 are shown somewhat reentrant and defining a throat 26 of a space 47 between the sidewalls 42 and 44.

In the relaxed state of the device 30, the sidewalls 43 and 45 are normally closer together than the width of the heel portion 28 of boot 26 or the heel portion 38 of shoe 36, respectively. The device 30 may be fabricated in different sizes, that is with different spacings between the reentrant edges 43 and 45 in the relaxed state of the device 30. In other words, the device 30 may be formed in sizes to fit different sizes of shoes or boots while being snugly fittable over the shoe or boot of the intended size. It is contemplated that the device 30 may also be formed in a one size fits all or as few as two or three different sizes to accommodate all sizes of shoes and boots. The device 30 may be of a width delimited by top and bottom edges 41*a* and 41*b* which is preferably at least one half the height of the heel portion of a shoe or boot, as shown. Accordingly, the device 30 is fitted over the heel of a shoe or boot, such as the boot 26 or the shoe 36, by manipulating the device to spread the sidewalls 42 and 44 away from each other while slipping the device into its working position, as illustrated in FIGS. 1 and 2, and then releasing the sidewalls so that they elastically clamp onto the sides of the shoe or boot. Alternatively, the device 30 may simply be forced over the heel portion of a shoe or boot since the sidewalls 42 and 44 will elastically deflect away from each other relatively easily.

Figure 6:
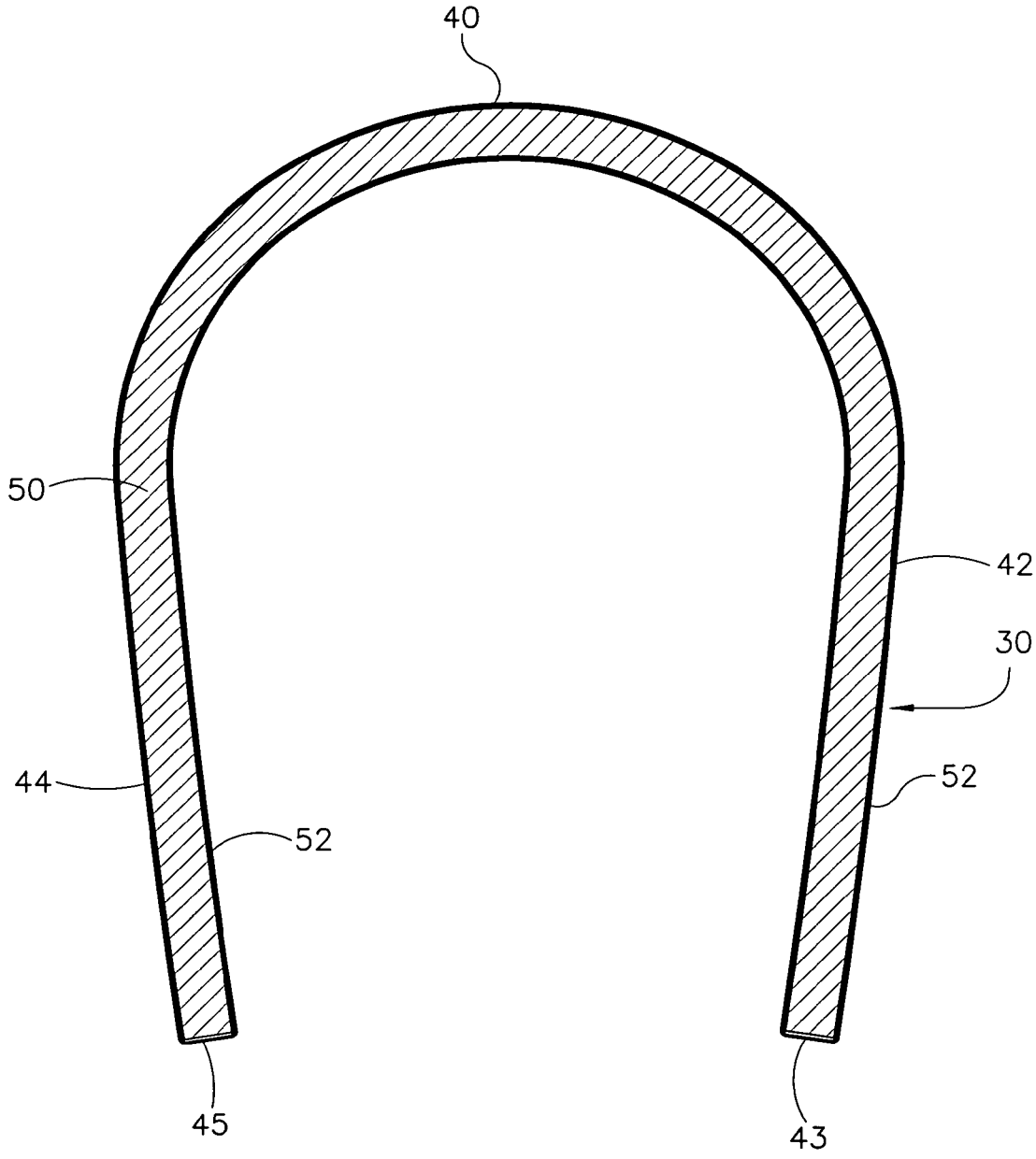
FIG. 6 is a section view taken generally along the line 6-6 of FIG. 5.

The device 30 may be fabricated of different materials. For example, the device 30 may be molded of a suitable thermoplastic having enough elasticity to provide for deflection of the sidewalls 42 and 44 while retaining enough elastic memory to allow the device 30 to grip a shoe or boot onto which it has been clamped or disposed. FIG. 6 illustrates in detail an embodiment of the device 30 wherein an inner elastic metal core part 50 is formed to have the same general shape as the finished form of the device 30 and the metal core part 50 is then coated with a layer of material, such as a thermoplastic polymer, which may be molded thereover or otherwise applied thereto, such as by spraying the polymer material onto the core part before a hardening reaction is completed. In this way the metal core part 50 is completely encapsulated by the layer 52 of plastic material, which may comprise an epoxy, for example. Substantial elasticity may be provided for the device 30 since the core part 50 may, for example, be formed of spring steel or the like, or a composite, such as a fiber reinforced polymer material, or even a non-reinforced plastic, and operable to withstand many cycles of deflection of the sidewalls 42 and 44 when the device 30 is slipped onto and off of a shoe or boot. Moreover, the outer layer or coating of plastic material may be of one of a variety of colors and offer some additional protection to a shoe or boot as the device 30 is slipped onto or off of the shoe or boot.

Figure 7A:
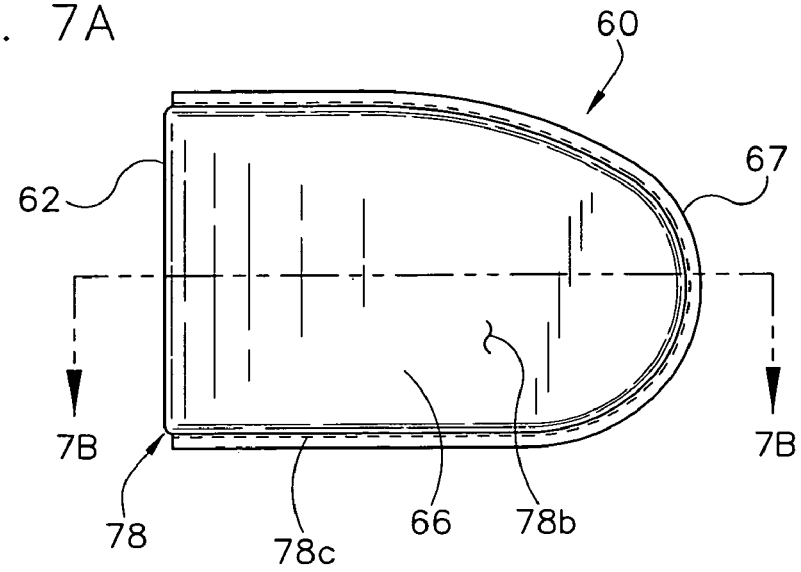
FIG. 7A is a side elevation of another preferred embodiment of a shoe protection device in accordance with the invention.
Figure 7B:
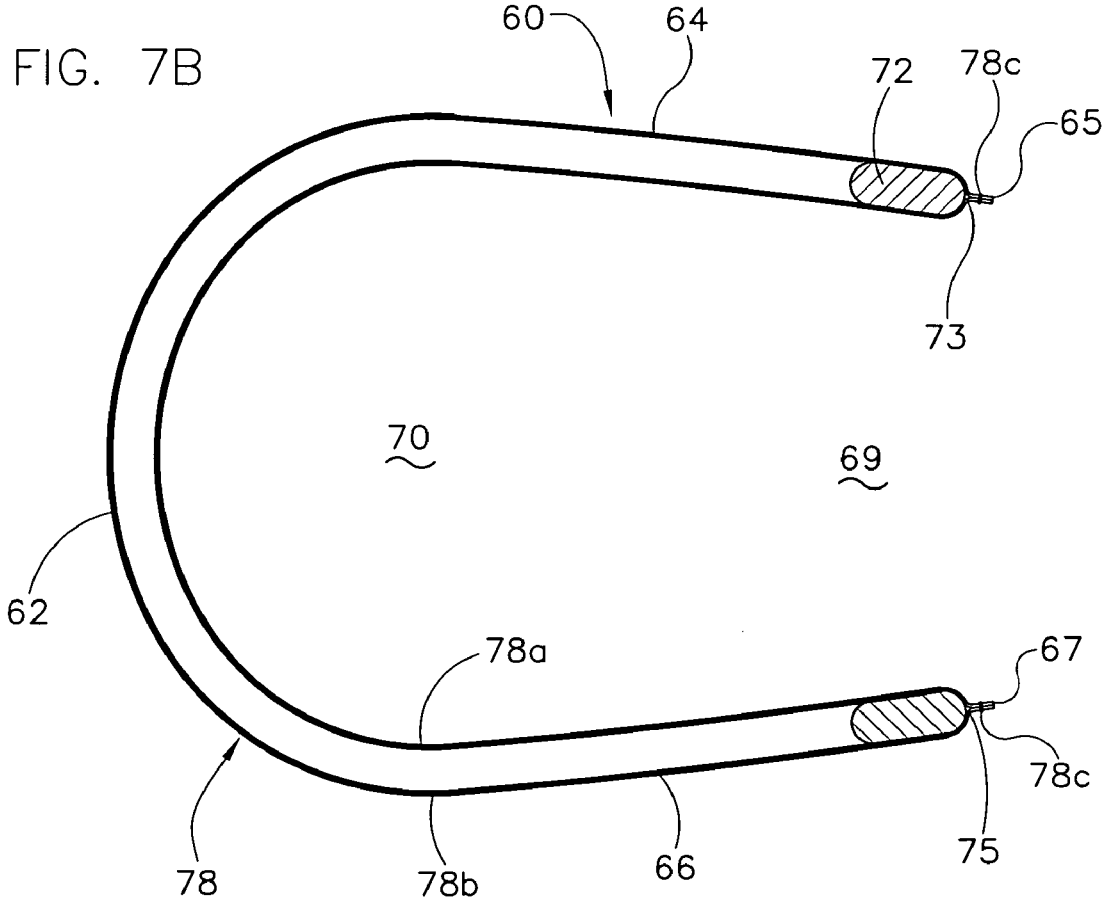
FIG. 7B is a section view taken along line 7B-7B of FIG. 7A.
Figure 7C:
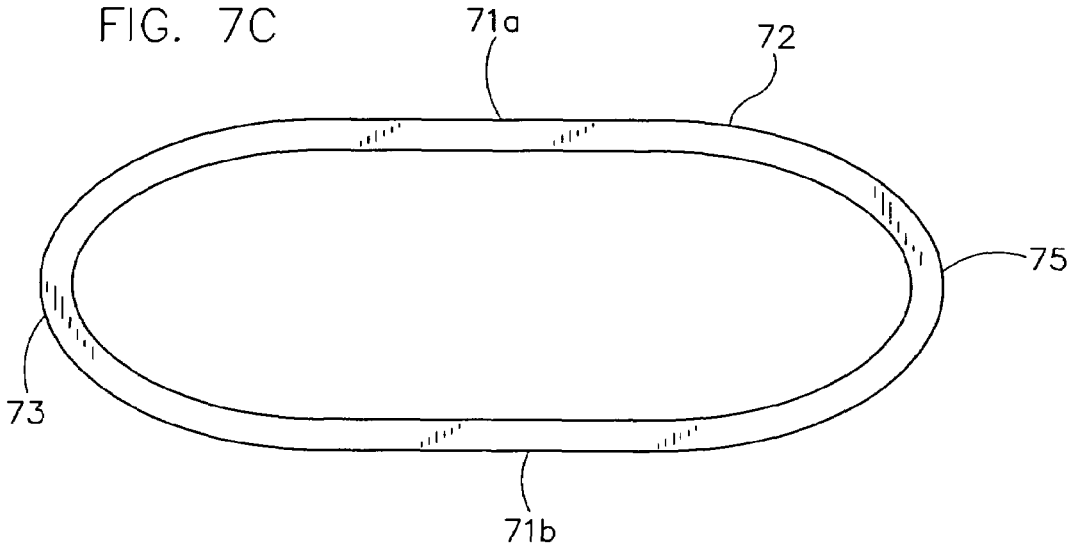
FIG. 7C is a developed plan view of a perimeter bandlike core part of the embodiment of the invention shown in FIG. 7A.
Figure 7D:
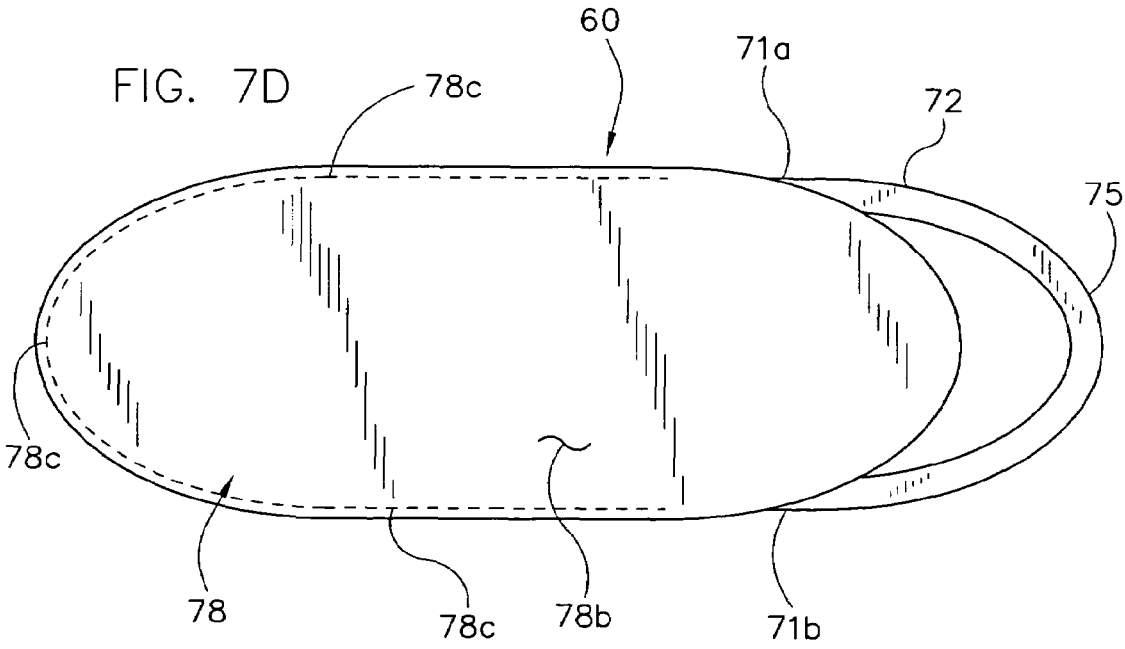
FIG. 7D is a developed plan view of the embodiment shown in FIG. 7A illustrating how a socklike cover or envelope may be sleeved over or mounted on the developed elastic core part.
Figure 7E:
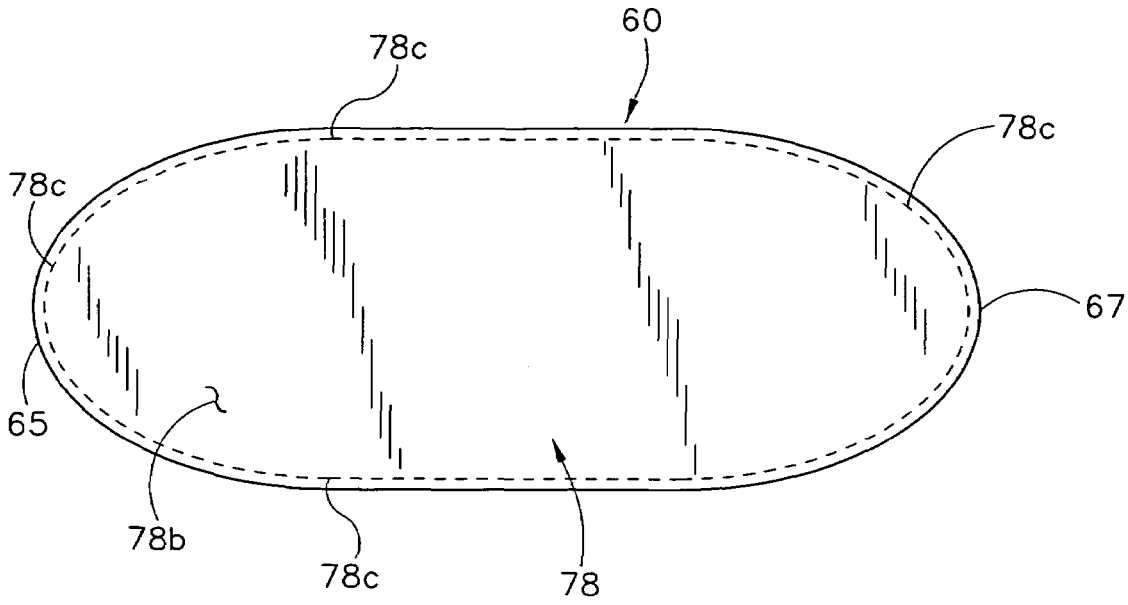
Figure 7F:
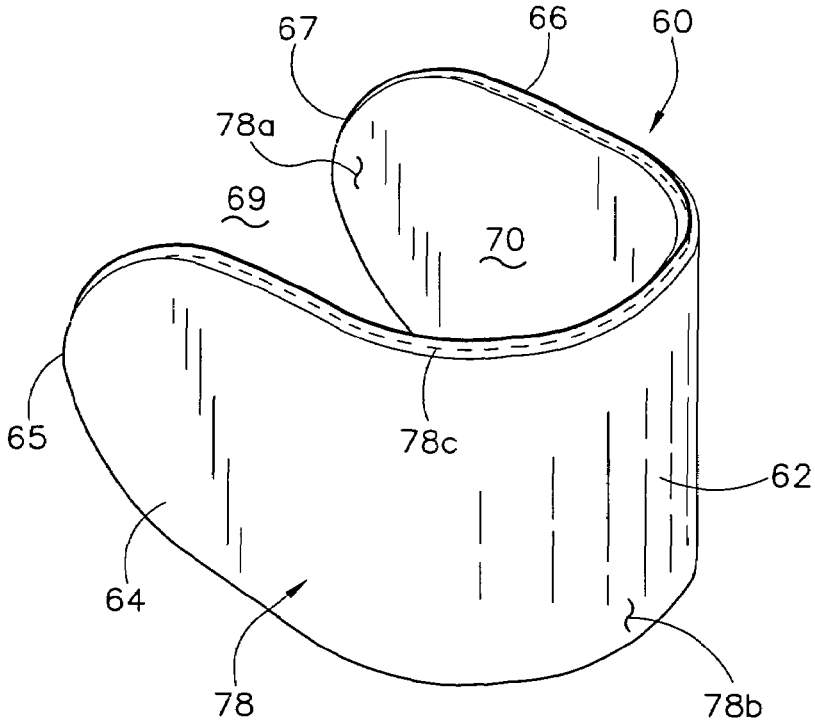
FIG. 7F is a perspective view of the embodiment shown in FIGS. 7A through 7E in its finished configuration.

Referring now to FIGS. 7A and 7F, there is illustrated a shoe protection device, similar in some respect to the device 30, and generally designated by the numeral 60. The device 60 is of the same general shape as the device 30 and includes an arcuate backwall 62 integrally joined to opposed sidewalls 64 and 66, FIG. 7F, which are delimited by reentrant distal ends 65 and 67. Accordingly, the spacing between the distal ends 65 and 67 forms a throat 69 for a larger space 70 and the width of the throat 69 between ends 65 and 67 is less than the width of the space 70, see FIG. 7B also. Shoe protection device 60 is further characterized by an elastically deformable perimeter core part 72, FIGS. 7B and 7C, which may be formed of a suitable elastic material, such as a thermoplastic or spring steel, for example. Core part 72 is shown in a developed plan view in FIG. 7C and includes somewhat linear perimeter sections 71*a* and 71*b* integrally joined to somewhat arcuate opposed distal ends 73 and 75 which also form the distal ends 65 and 67 of the finished device illustrated. The perimeter core part 72 may thus be formed to define the shape of the device 60, as shown in FIGS. 7B and 7F by deformation of the perimeter core part 72 in a mold or over an anvil, preferably as a final or near final step in the fabrication of the device. The perimeter core part 72 may also be preformed in the shape shown in FIGS. 7B and 7F. The device 60 is operable to be elastically deflected to allow the device to be slipped over a shoe or boot in a manner substantially like that shown and described for the device 30.

However, the device 60 is further provided with a flexible, nonabrasive socklike sleeve or cover member 78 which may be sleeved over the core part 72, as shown in FIG. 7D, until the member 78 is positioned to entirely encapsulate the perimeter core part 72. The cover or sleeve 78 may then be closed to retain the perimeter core part 72 therein or left open so that the perimeter core part may be removed from the sleeve and the sleeve replaced by one of a different color or different type of fabric. The socklike sleeve or cover 78 may be formed of opposed panels 78*a* and 78*b*, FIG. 7B, and at least partially stitched along the perimeter thereof, as indicated at 78*c*. However, the stitching 78*c* is not completed until the core part 72 is inserted in the sleeve 78. Accordingly, the device 60 may utilize a socklike cover or sleeve 78 of different colors or different fabrics or other flexible materials, such as leather or plastic, which may match the colors or composition of shoes or boots with which they are to be worn. The sleeve 78 may be permanently closed by stitching 78*c* extending around the entire perimeter of device 60 once the perimeter part 72 is disposed therewithin. The panels 78*a* and 78*b* may be joined at their perimeters by other means including an adhesive or thermal bonding, for example, depending on the material used for the panels. As mentioned above, the perimeter core part 72 may also be preformed to have the shape shown in FIG. 7F. However, the perimeter core part 72 may be elastically deflected to allow the sleeve 78 to be sleeved thereover and then allowed to relax to resume a shape that corresponds generally to the shape of the device 30.

The fabrication and use of the devices 30 and 60 is believed to be within the purview of one skilled in the art of shoe protection devices based on the foregoing description. The use of the devices 30 and 60 is also believed to be readily understandable to those skilled in the art based on the foregoing description when read in conjunction with the drawings. Although preferred embodiments of the invention have been described in detail herein, those skilled in the art will also recognize that various substitutions and modifications may be made without departing from the scope and spirit of the appended claims.

What is claimed is:

1. A shoe protection device for protecting the heel of a shoe or boot comprising:

a member having an arcuate backwall and opposed sidewalls joined to said backwall, said sidewalls being elastically deflectable to slip said device over a heel of a shoe or boot while allowing said sidewalls to relax and frictionally grip said shoe or boot to retain said device on said shoe or boot;

said sidewalls have distal ends which, in a relaxed condition of said device, are disposed closer together than the distance between said sidewalls adjacent said backwall;

said device is formed of an elastically deflectable perimeter core part formed of a substantially flat band of one of thermoplastic and spring steel and including two opposed substantially linear sections spaced apart and each joined at their opposite ends to opposed arcuate distal ends of said core part forming, in a developed plan view, a substantially oval shape, said distal ends of said core part defining said distal ends of said sidewalls; and a cover member formed of a flexible sheet material sleeved over said core part and positioned to entirely encapsulate said core part, said cover member having opposed ends and being open at one of said ends to allow removal of said core part from said cover member and replacement or placement of said core part in another cover member of one of a different color and different material, said cover member being formed of opposed panels at least partially secured to each other along a perimeter thereof.

2. The device set forth in claim 1 wherein:

said core part is one of initially shaped to provide for said sidewalls to be disposed closer together than said distance between said sidewalls adjacent said backwall and deformed by placing said perimeter core part in a mold or over an anvil.

3. The device set forth in claim 1 wherein:

said cover member is closed at said one end by a closure including one of stitching and an adhesive.

4. The device set forth in claim 1 wherein:

said cover member is formed of said flexible sheet material selected from a group consisting of fabric, leather and plastic.

5. A shoe protection device for protecting the heel of a shoe or boot comprising:

a member having an arcuate backwall and opposed sidewalls joined to said backwall, said sidewalls being elastically deflectable to slip said device over a heel of a shoe or boot while allowing said sidewalls to relax and frictionally grip said shoe or boot to retain said device on said shoe or boot;

said sidewalls have distal ends which, in a relaxed condition of said device, are disposed closer together than the distance between said sidewalls adjacent said backwall;

said device is formed of an elastically deflectable perimeter core part formed of a substantially flat band of one of thermoplastic and spring steel and including two opposed substantially linear sections spaced apart and each joined at their opposite ends to opposed arcuate distal ends of said core part forming, in a developed plan view, a substantially oval shape, said distal ends of said core part defining said distal ends of said sidewalls;

a cover member formed of a flexible sheet material sleeved over said core part and positioned to entirely encapsulate said core part, said cover member having opposed ends and being open at one of said ends to allow removal of said core part from said cover member and replacement or placement of said core part in another cover member of one of a different color and different material, said cover member being formed of opposed panels at least partially secured to each other along a perimeter thereof; and said core part is one of initially shaped to provide for said sidewalls to be disposed closer together than said distance between said sidewalls adjacent said backwall and deformed by placing said core part in a mold or over an anvil.

* * * * *